US011267667B2

(12) United States Patent
Schalk et al.

(10) Patent No.: US 11,267,667 B2
(45) Date of Patent: Mar. 8, 2022

(54) ADJUSTABLE PIVOTS

(71) Applicant: Hewlett-Packard Development Company, L.P., Houston, TX (US)

(72) Inventors: Wesley R Schalk, Camas, WA (US); Al Olson, Vancouver, WA (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 534 days.

(21) Appl. No.: 16/067,284

(22) PCT Filed: Apr. 29, 2016

(86) PCT No.: PCT/US2016/030140
§ 371 (c)(1),
(2) Date: Jun. 29, 2018

(87) PCT Pub. No.: WO2017/188996
PCT Pub. Date: Nov. 2, 2017

(65) Prior Publication Data
US 2019/0023508 A1 Jan. 24, 2019

(51) Int. Cl.
*B65H 3/06* (2006.01)

(52) U.S. Cl.
CPC ..... *B65H 3/0684* (2013.01); *B65H 3/0669* (2013.01); *B65H 2402/31* (2013.01); *B65H 2402/32* (2013.01); *B65H 2403/531* (2013.01)

(58) Field of Classification Search
CPC .. B65H 3/0607; B65H 3/0615; B65H 3/0638; B65H 3/0684; B65H 3/0669; B65H 3/0653; B65H 2402/31; B65H 2404/1421; B65H 2404/1521
See application file for complete search history.

(56) References Cited

U.S. PATENT DOCUMENTS

| | | | | |
|---|---|---|---|---|
| 4,928,951 A * | 5/1990 | Fukui | B65H 3/5261 271/113 |
| 5,709,381 A | 1/1998 | Hourtash et al. | |
| 6,254,080 B1 * | 7/2001 | Bass | B65H 3/0684 271/10.11 |

(Continued)

FOREIGN PATENT DOCUMENTS

| | | |
|---|---|---|
| CN | 1483588 | 3/2004 |
| CN | 102674031 | 9/2012 |
| CN | 105774265 A | 7/2016 |
| JP | 503176 | 1/1975 |

OTHER PUBLICATIONS

HP Printers—Using the HP AiO Printer Remote App (Android & Apple), 2016, < http://support.hp.com/in-en/document/c03561640 > 4 pages.

*Primary Examiner* — Thomas A Morrison
(74) *Attorney, Agent, or Firm* — HP Inc. Patent Department

(57) ABSTRACT

In one example, a media feed system includes a pick arm that is adjustable at a pivot and operable to maintain a distance between a pick roller and a separation wall as the pick arm changes orientation. In another example, a media feed system may include a pick arm, a pick roller coupled to the pick arm, a pivot coupled to the pick arm, and a plate coupled to the pivot via a pin and slot interface. In that example, a slot of the pin and slot interface is to adjust position of the pivot and adjust orientation of the pick arm.

9 Claims, 11 Drawing Sheets

(56) References Cited

U.S. PATENT DOCUMENTS

| | | | | |
|---|---|---|---|---|
| 6,322,065 | B1 * | 11/2001 | Underwood | B65H 3/0623 271/117 |
| 6,375,183 | B1 | 4/2002 | Inoue et al. | |
| 6,463,255 | B1 * | 10/2002 | Shultz | B41J 13/103 271/117 |
| 6,572,096 | B1 | 6/2003 | Johnson et al. | |
| 6,866,259 | B2 | 3/2005 | Underwood et al. | |
| 7,331,574 | B2 | 2/2008 | So | |
| 7,583,979 | B2 | 9/2009 | Silverbrooks | |
| 7,852,526 | B2 | 12/2010 | Mo et al. | |
| 7,917,168 | B2 | 3/2011 | Silverbrook | |
| 7,963,519 | B2 * | 6/2011 | Bokelman | B65H 3/0684 271/117 |
| 8,231,121 | B2 | 7/2012 | Wang | |
| 8,322,709 | B2 | 12/2012 | Blair et al. | |
| 8,342,507 | B2 * | 1/2013 | Takahashi | B65H 3/18 271/18.1 |
| 8,636,277 | B1 | 1/2014 | Blair et al. | |
| 8,823,962 | B2 | 9/2014 | Maghakian et al. | |
| 8,970,869 | B2 | 3/2015 | Park | |
| 2002/0060392 | A1 | 5/2002 | Underwood et al. | |
| 2002/0084574 | A1 | 7/2002 | Kim | |
| 2005/0140078 | A1 | 6/2005 | Fujiwara | |
| 2007/0001373 | A1 | 1/2007 | Soo | |
| 2007/0120315 | A1 * | 5/2007 | Steinhilber | B65H 3/0615 271/109 |
| 2008/1022162 | | 5/2008 | Boklman | |
| 2011/0204558 | A1 | 8/2011 | Takahashi et al. | |

* cited by examiner

ADJUSTABLE PIVOTS

BACKGROUND

Imaging devices retain media and feed media along a media path within the imaging device to perform imaging operations on the media at various places in the imaging device. Media may generally be kept in a media tray assembly and a pick mechanism may be used to obtain media from the media tray assembly to enter the media path.

DETAILED DESCRIPTION

In the following description and figures, some example implementations of tray assembly apparatus, media feed systems, and/or methods of operating a media feed system are described. The examples discussed herein are useable with an imaging device, such as a copying device or a printing device. In examples described herein, a "printing device" may be a device to print content on a physical medium (e.g., paper or a layer of laminate build material, etc.) with a printing fluid (e.g., ink) or toner. A printing device may utilize suitable printing consumables, such as ink, toner, fluids or powders, or other raw materials for printing. An example of printing fluid is ink ejectable from a printhead.

A printing device may retain media in particular areas of the printing device. For example, an input tray may contain blank media to be printed on and an output tray may retain printed on media. Example media types include paper, photo paper, cardboard, cardstock, plastic, film, canvas, textile, or other appropriate substrates able to receive printing fluid. A media path may exist between the particular areas of the printing device with components to assist movement of the media along the media path. Media may generally be kept in a media tray assembly and a pick mechanism may be used to obtain media from the media tray assembly to enter the media path. Example pick systems may include D-shaped pick tires and hanging pick arms. In a hanging pick arm environment, the pick arm may have a fixed length and a fixed pivot so that, as the media stack height decreases, a pick roller at the end of the pick arm may change distances from the separation mechanism.

Various examples described below relate to a media feed system that is able to maintain a distance between a pick roller and a separation wall by using a variable pivot of a pick arm. In some examples, the pick arm pivot changes concurrently with a feed angle of a separation mechanism. By adapting the pick mechanism and/or separation mechanism as described herein, media may be fed into a media path of an imaging device with, for example, improved reliability across a range of media stack heights, in particular with regard to an angled separator wall.

The terms "include," "have," and variations thereof, as used herein, mean the same as the term "comprise" or appropriate variation thereof. Furthermore, the term "based on," as used herein, means "based at least in part on." Thus, a feature that is described as based on some stimulus may be based only on the stimulus or a combination of stimuli including the stimulus. Furthermore, the term "maintain" (and variations thereof) as used herein means "to keep within a 10% range of a condition." Furthermore, as used herein, the terms "substantially," "about," and "approximately" mean "within a 10% range of."

Figure 1:
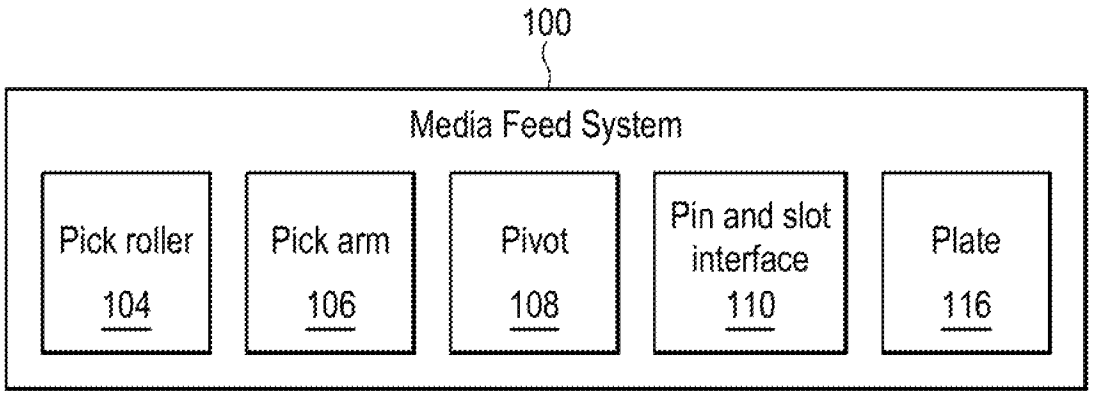
FIGS. 1 and 2 are a block diagram depicting example media feed systems.
Figure 2:
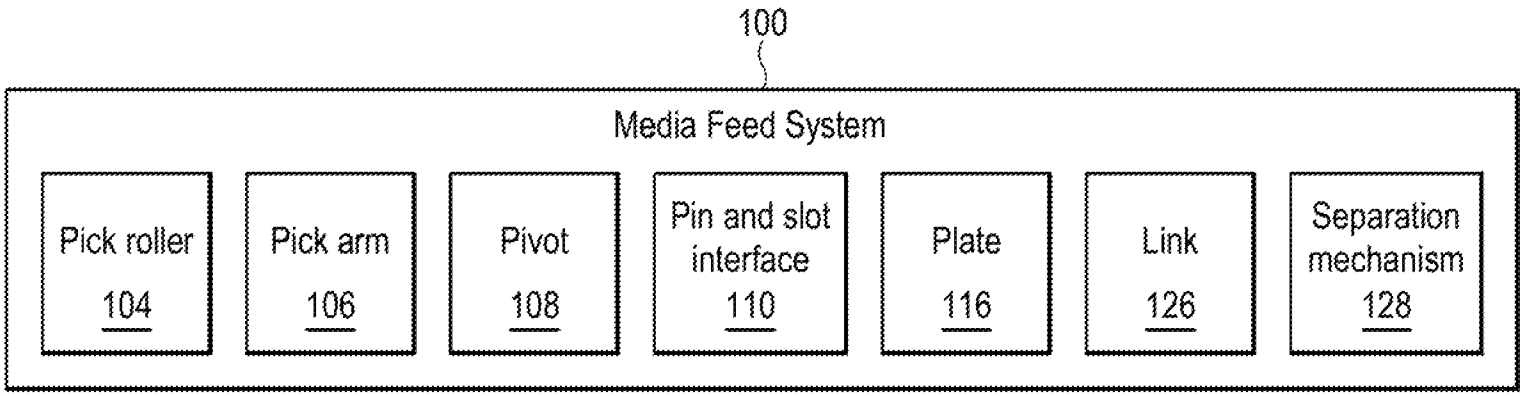
Figure 8A:
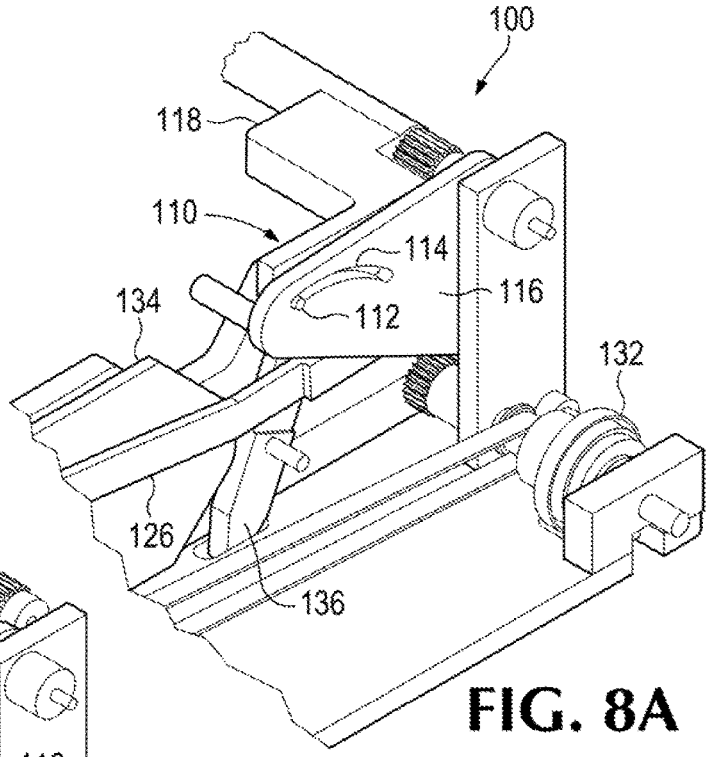
Figure 8B:
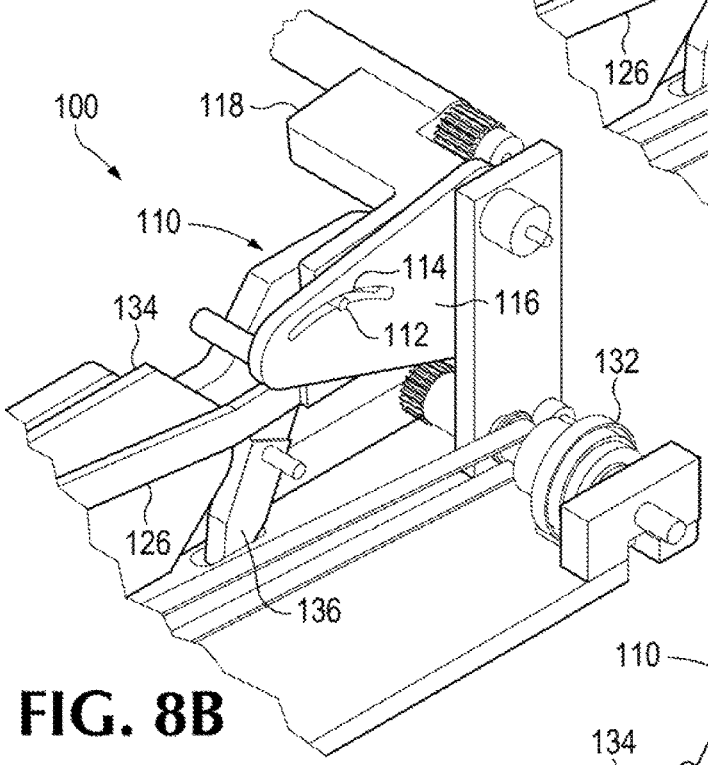
Figure 8C:
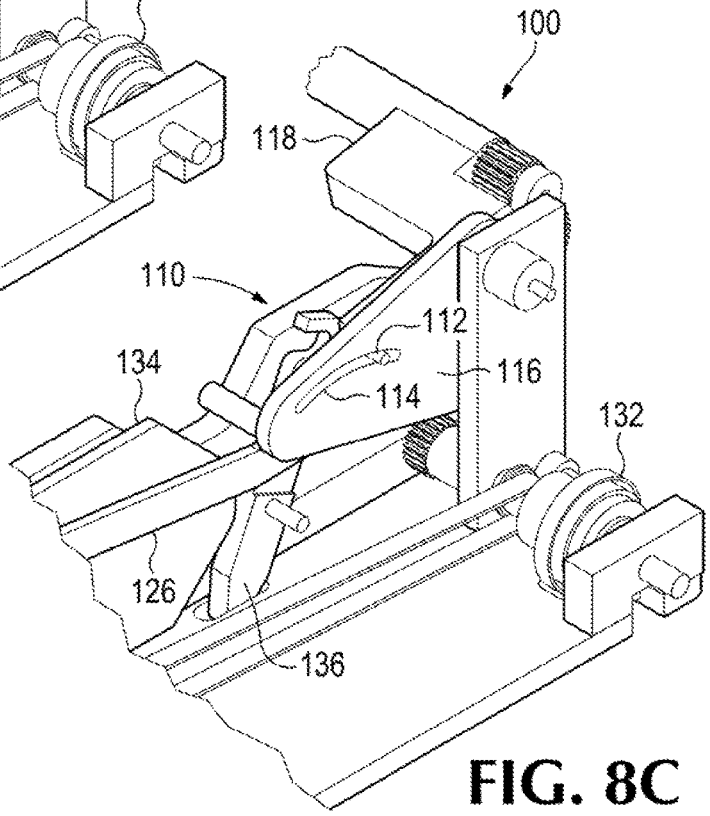

FIGS. 1 and 2 are a block diagram depicting example media feed systems 100. Referring to FIG. 1, the example media feed system 100 includes a pick roller 104, a pick arm 106, a pivot 108, a pin and slot interface 110, and a plate 116. The pick roller 104 is coupled to a portion of the pick arm 106, such as a distal end of the pick arm 106. The pivot 108 is coupled to the pick arm 106, such as a proximate end of the pick arm 106. The plate 116 is coupled to the pivot 108 via the pin and slot interface 110. In the example of FIGS. 8A-C, the pin and slot interface includes a pin 112 protruding from a pick arm lift shaft 118 and a slot 114 defined by a surface of the plate 116.

The geometry of the slot 114 may facilitate movement of a pivot 108 along a path. For example, the geometry of the slot 114 may define a path so that as the pin 112 moves along the path, the pivot 108 adjusts position and the pick arm 106 adjusts orientation. The geometry may be designed to maintain the pick roller 104 at a particular distance from a separation wall 120 as the pick roller 104 changes based on stack height. For example, the geometry of the slot 114 in FIGS. 3B and 3C is approximately a relatively shallow arc. In this manner, the pick arm 106 adjust orientation based on a position of the pick roller 104 and the pivot 108 adjusts position based on orientation adjustment of the pick arm 106 (as directed by the geometry of the slot 114 of the pin and slot interface 110).

Referring to FIG. 2, the media feed system 100 may include a link 126 coupled to the plate 116 and a separation mechanism 128. The components may be coupled such that the movement of the pick roller 104 translates into movement of the separation mechanism 128 via a chain of movements across the pick arm 106, pivot 108, plate 116, and link 126. The components discussed herein may be orientationably adjustable in accordance with the description herein. In other words, the movements may be changed in relative position and/or relative rotation. In this manner, the feed angle of the separation mechanism 128 is adjustable in conjunction with adjustments of the pick roller position (e.g., adjustable based on stack height).

Figure 3A:
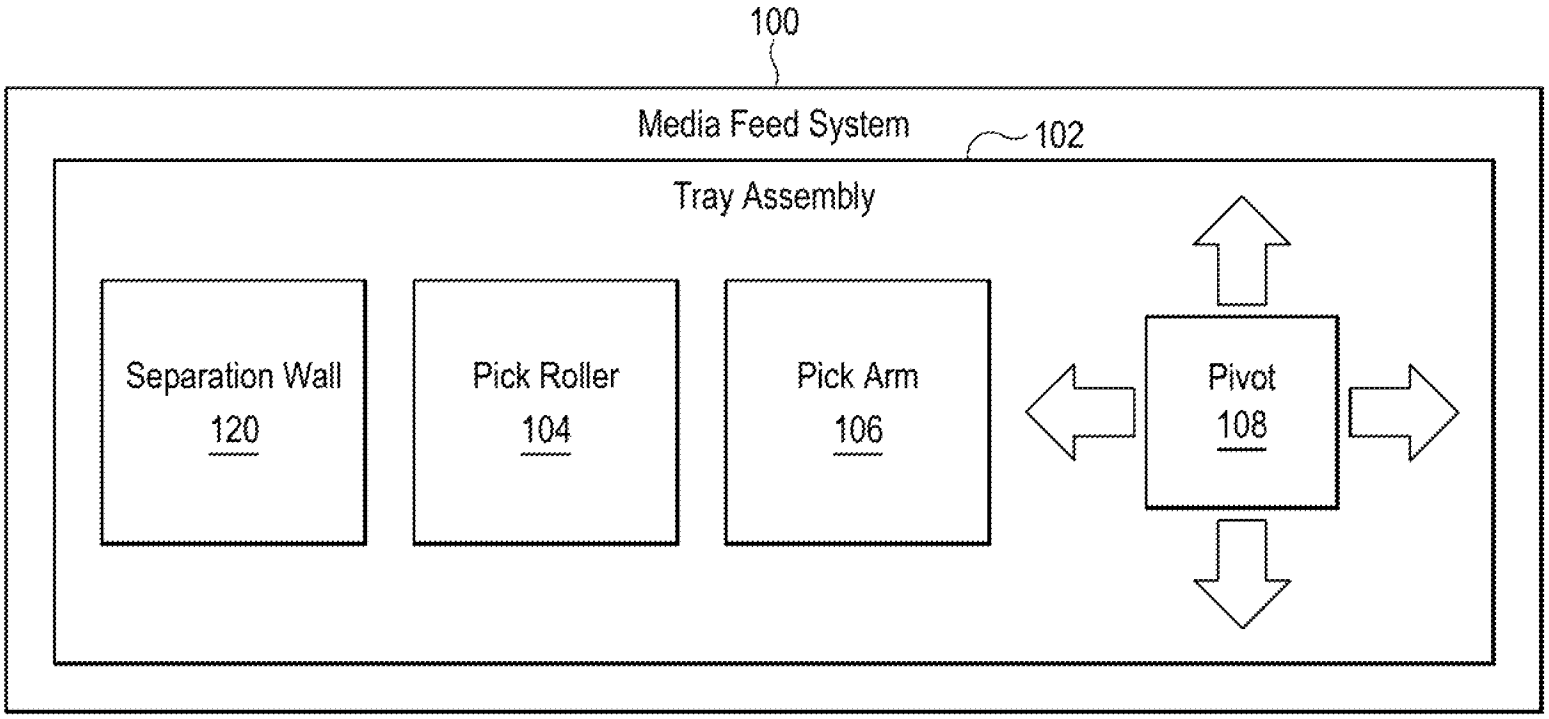
FIG. 3A is a block diagram depicting an example tray assembly.
Figure 3B:
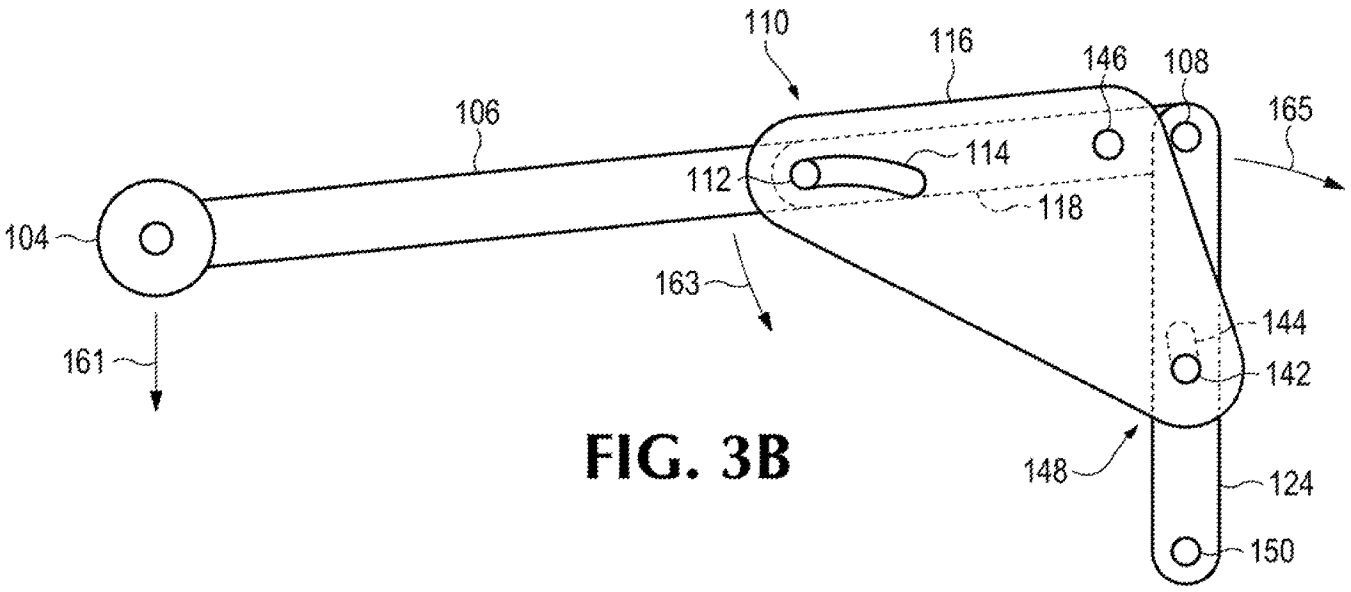
FIGS. 3B and 3C are diagrams depicting example movements of example components of an example media feed system.
Figure 3C:
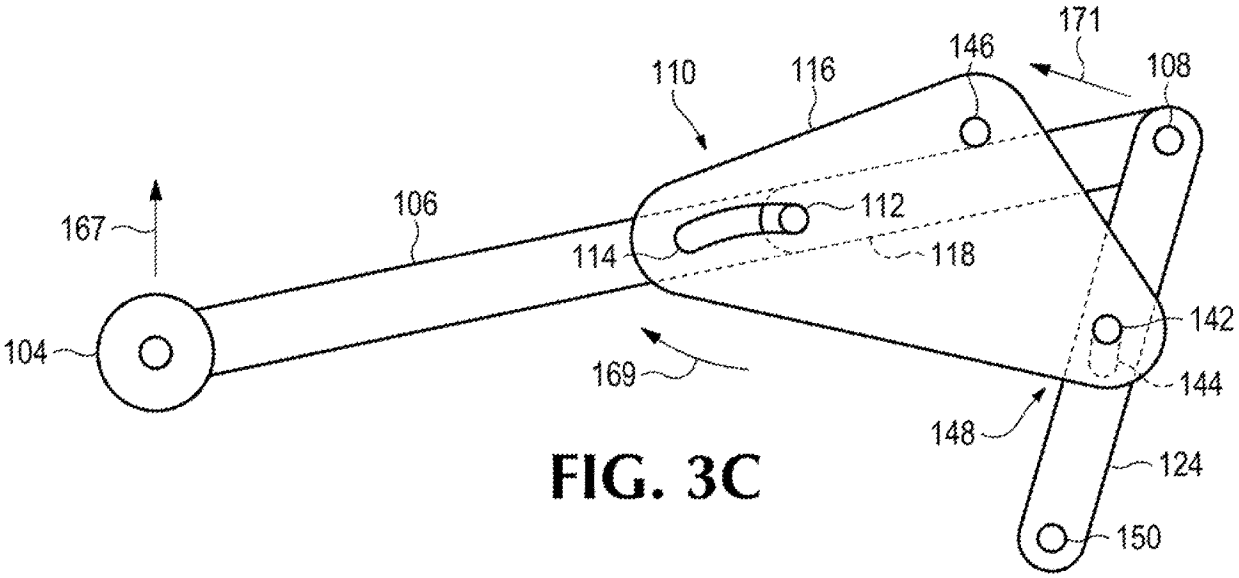

FIG. 3A is a block diagram depicting an example tray assembly 102 of a media feed system 100. The media feed system 100 of FIG. 3A includes an example tray assembly 102. A separation wall 120, a pick roller 104, a pick arm 106, and a pivot 108 are located within the tray assembly 102. The pick arm 106 is coupled to a pick roller 104 and a pivot 108, such as at opposing ends of the pick arm 106. The pivot 108 is able to vary in position to allow the pick arm 106 to be oriented based on how the pivot 108 is adjusted. The pivot 108 may be allowed to move along a particular path so that the pick arm 106 moves to be operable to maintain a distance between the pick roller 104 and the separation wall 120 as the pick arm 106 changes orientation.

FIGS. 3B and 3C are diagrams depicting example movements of example components of an example media feed system. The example components of a pick roller 104, a pick arm 106, a pivot 108, a plate 116, a pick arm lift shaft 118, and a pivot link 124. The interfaces of the components, including pin and slot interfaces 110 and 148, allow the components to move in a particular relationship so that that the pivot 108 adjusts position based on the position of the pick roller 104. The pin and slot interface 110 includes a pin 112 (of the pick arm lift shaft 118) and a slot 114 (of the plate 116), and the pin and slot interface 148 includes a pin 142 (of the plate 116) and a slot 144 (of pivot link 124). The pins 112 and 142 are orthogonally locatable within paths defined by slots 114 and 144, respectively. Referring to FIG. 3B, when the pick roller 104 moves in the direction of 161, a pin 112 moves along a path defined by slot 114, the movement of pin 112 rotates the plate 116 around a pin 146 in the direction 163, the movement of the plate 116 adjusts the force on pin 142 in slot 144, the force on the pin 142 moves the pivot link 124 to rotate around pin 150 in the direction 165, and this results in substantial movement of the position of the pivot 108 in the direction of 165. Referring to FIG. 3C, when the pick roller 104 moves in the direction of 167, the pin 112 moves along slot 114, the movement of pin 112 rotates the plate 116 around the pin 146 in the direction 169, the movement of the plate 116 adjusts the force on the pin 142 in slot 144, the force on pin 142 moves the pivot link 124 to rotate around pin 150, and this results in substantial movement of the position of the pivot 108 in the direction of 171. In this manner, the paths defined by the pin and slot interfaces 110 and 148 direct the pivot 108 to adjust the orientation of the pick arm 106 as the pick roller 104 changes in height, and the pick roller 104 may be moved along a path substantially parallel to the surface of a separation wall (not shown), such as the angle of the separation wall 120 in FIGS. 5-7.

Figure 4:
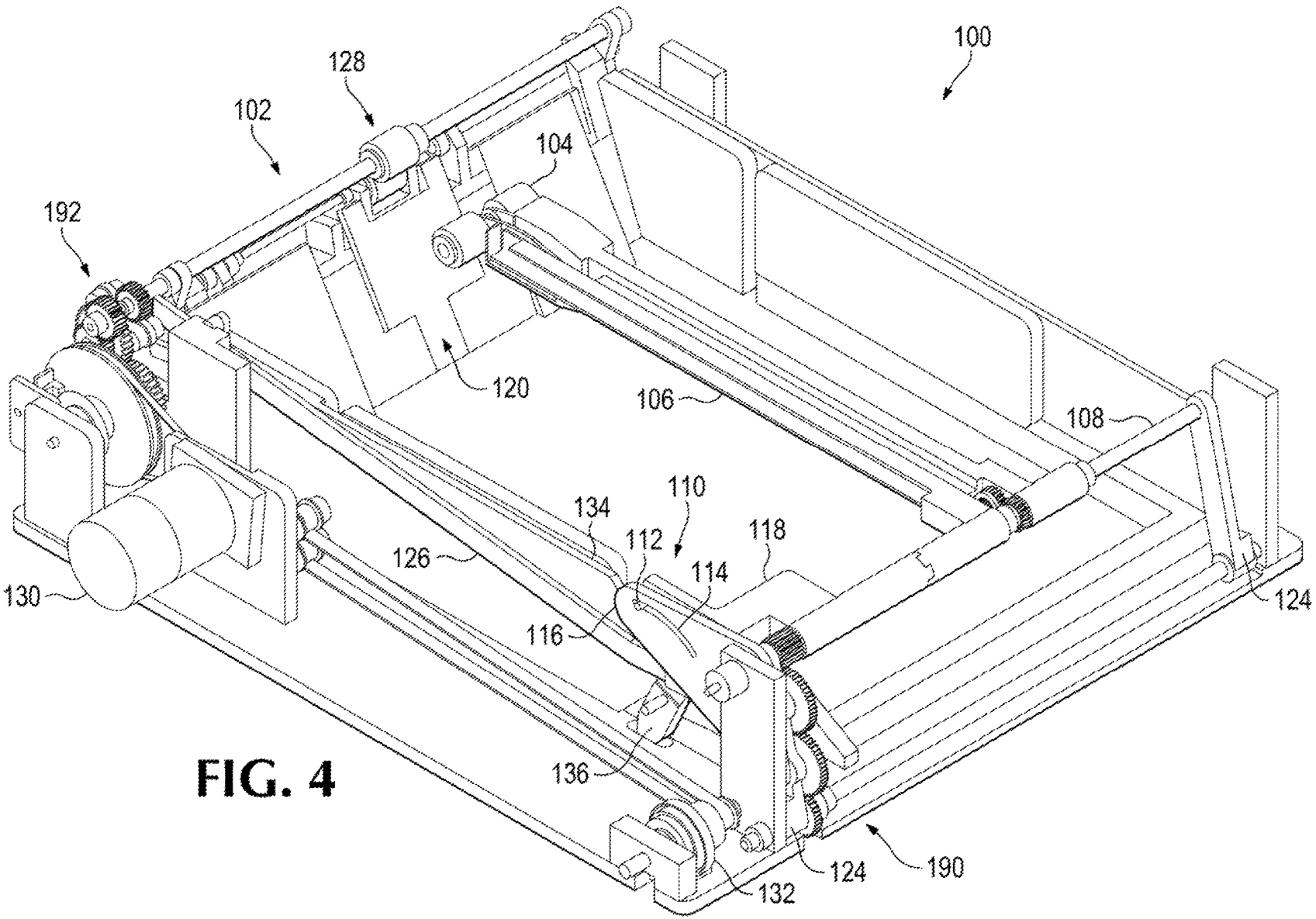
FIG. 4 is a perspective view of an example media feed system.

FIG. 4 is a perspective view of an example media feed system 100. The example media feed system 100 of FIG. 4 includes a pick roller 104, a pick arm 106, a pivot 108, a pick arm lift shaft 118, a pivot link 124, and a pick arm lift plate 116. The pick arm 106 is adjustable at the pivot 108 and operable to maintain a distance between the pick roller 104 and the separation wall 120 as the pick arm 106 changes orientation. A first end of the pick arm 106 is coupled to a pick roller 104 and a second end of the pick arm 106 is coupled to the pivot 108. The pivot 108 moves along a path guided by the pivot link 124 and geometry of the pick arm lift plate 116. The pivot link 124 is rotatable around a first end and is coupled to the pivot 108 at a second end of the pivot link 124. The pick arm lift shaft 118 extends from the pivot 108 and may adjust according to changes in position of the pick roller 104. For example, the pivot position of the pick arm 106 may be adjustable based on the height of the pick roller 104. For another example, the pick arm lift shaft 118 is coupled to the pivot 108 to rotate and move the pivot 108 as a pin 112 moves along a path defined by a slot 114 of a pin and slot interface 110. The pick arm 106 may rotate dependent on the pick arm lift shaft 118, and the pivot 108 may rotate independent of the pick arm lift shaft 118.

The pick arm 106 may be relatively long (e.g., above an average length of hanging pick arms used in personal or office printers.) For example, the length of the pick arm 106 may be substantially the length of the media or greater than the length of the media. The relatively long pick arm length may avoid locking the arm in particular orientations. The length of the pick arm 106 may suited towards for the capacity of the tray assembly 102 or otherwise adapted for a depth of the tray assembly 102. For example, the pick arm 106 for a 800-sheet capacity tray may be longer than a 550-sheet capacity tray. A pick arm 106 with a length about the length of the media or greater may be used in trays with a capacity greater than 800 sheets, such as 1100-sheet capacity trays. In this manner, the pick arm 106 of the media feed system 100 described herein may be scalable to various sizes and capacities of tray assemblies.

The components of the media feed system 100 may be part of or otherwise connected by a linkage coupled to the pick arm 106. As used herein, a linkage may include any number of links and pivots. For example, the linkage may include the pivot 108, the pivot link 124, the pick arm lift plate 116 having a surface defining a slot 114, and a pick arm lift shaft 118 coupled to the pivot 108 and defining a pin 112 extending from the pick arm lift shaft 118 that is orthogonally locatable within the slot 114. The linkage may change a position of the pivot 108 dependent on a position of the pick roller 104 and may rotate the pivot 108 away from the separation wall 120 as the pick arm lowers.

The example media feed system 100 of FIG. 4 includes a separation mechanism linkage 126 that is able to adjust a feed angle of a separation mechanism. The separation mechanism linkage 126 is coupled to the pick arm lift plate 116 so that a feed angle of the separation mechanism is adjustable (via the separation mechanism linkage 126) based on the orientation of the pick arm lift plate 116. The separation rollers 128 are located near the top of an angled separation wall 120. The separation mechanism depicted in FIG. 4 includes separation rollers 128. In other examples, other separation means may be used including separation rollers, fixed or slidable separation pads, pinch rollers, take-away rollers, or any combination thereof. In yet other examples, no separation mechanism may be present within the tray assembly 102 or as part of the media feed system 100.

The example media feed system 100 of FIG. 4 includes a motor 130 and a clutch 132 operable to adjust the motor 130. The motor 130 of FIG. 4 is coupled to transmission systems 190 and 192 to allow the motor 130 to drive the pick roller 104 (through transmission system 190) and the separation rollers 128 (through the transmission system 192). For example, transmission system 190 may be a power train using a first arrangement of gears coupled to the link 124 that interact with a second arrangement of gears coupled to the pick arm 106 to rotate the pick rollers. The transmission systems 190 and 192 may be arranged using belts, gears, a combination thereof, or other appropriate transmission arrangements. The transmission systems 190 and 192 may be driven concurrently by the motor 130. The motor 130, in conjunction with the clutch 132, may be used to adjust the rotation of the pick roller 104 and/or move the pick arm 106. For example, the clutch 132 may be operably coupled to the motor 130 to operate the pick roller 104 (e.g., rotate the pick roller 104) and/or lift the pick arm 106 depending on the state of the clutch 132 to operate the motor 130 accordingly. For another example, the clutch 132 may be dual directional and selectable so that the clutch 132 may be selectable between neutral, engaged in a first direction to operate the pick roller 104, and engaged in a second direction to operate the pick arm 106. In this manner, the pick arm 106 may be liftable and adjustable.

The example media feed system 100 of FIG. 4 includes tray walls 134 and a pick arm lift lock 136. For example, the pick arm lift lock 136 may be a tray arm able to lock the pick arm 106 in a lifted state via the pick arm lift plate 116 and pick arm lift shaft 118. The pick arm 106 may be liftable to a lifted state via the motor 130 and/or the pick arm lift lock 136. The pick arm lift lock 136 is discussed in more detail with regards to FIGS. 10A-C.

Figure 5:
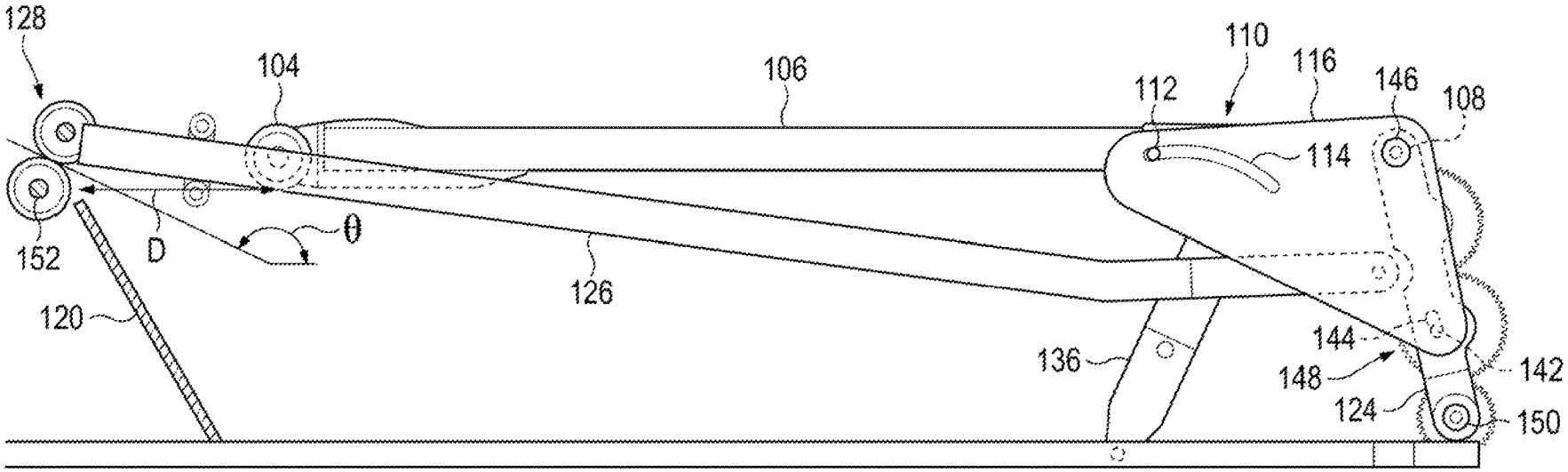
FIGS. 5-7, 8A-C, 9A-C, and 10A-C depict example states of an example media feed system.
Figure 6:
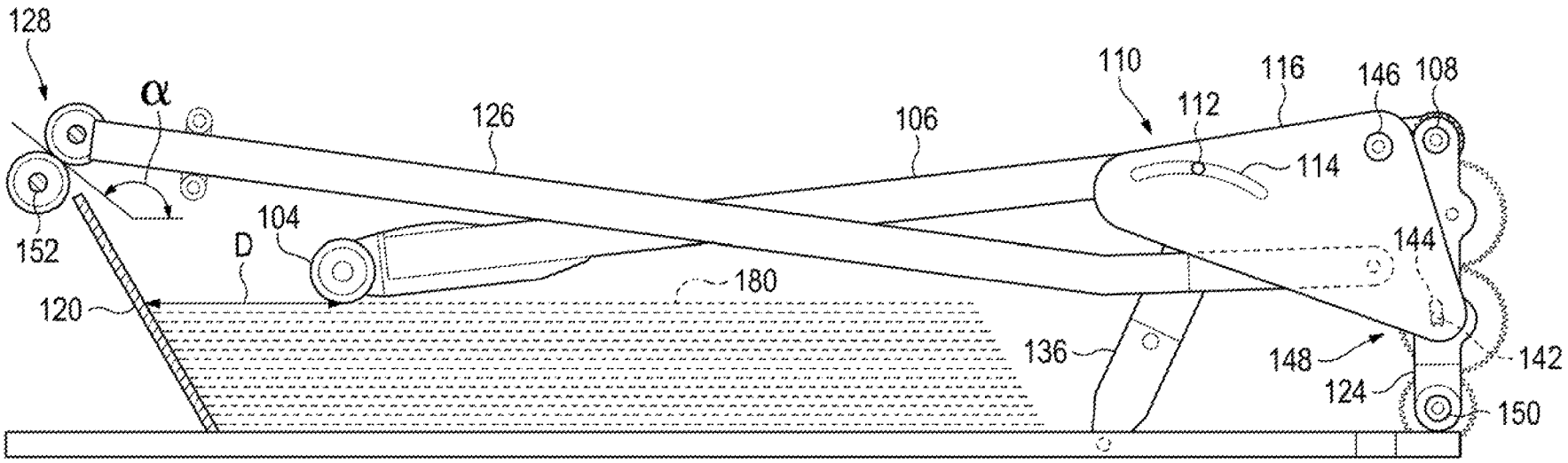
Figure 7:
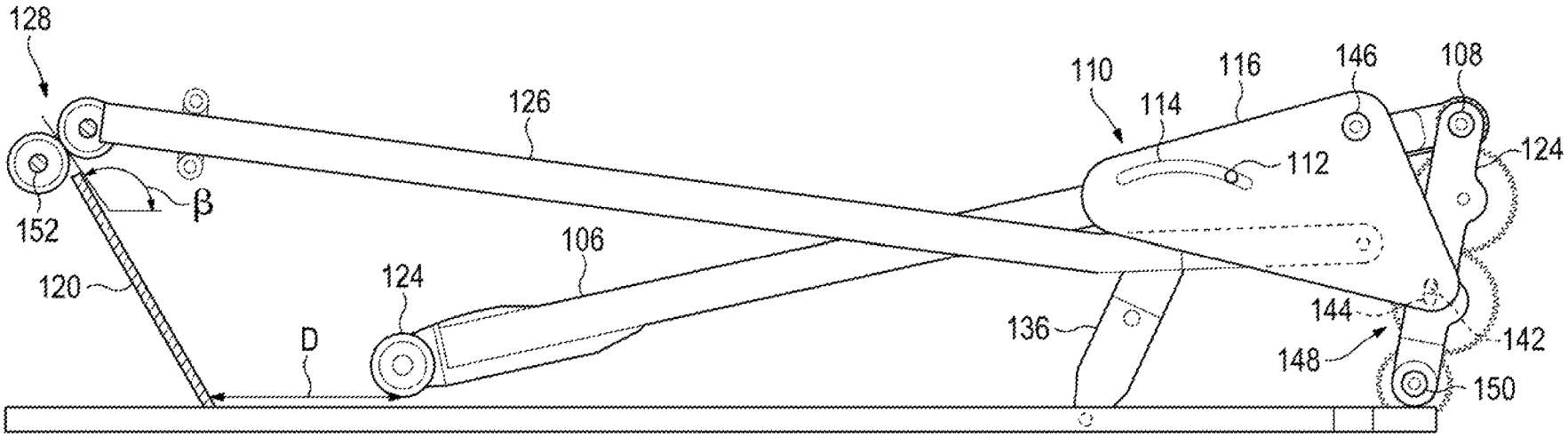

FIGS. 5-7, 8A-C, 9A-C, and 10A-C, depict example states of an example media feed system. FIGS. 5-7 are side views of the media feed system 100 at various states of operation. Referring to FIG. 5, the media feed system 100 is depicted at a pick roller up state (or a full media stack height state).

Referring to FIG. 5, the pick roller 104 is in a position with vertical alignment at about the top of the separation wall 120 and separated at a distance D from the separation wall (e.g., distance D along a horizontal plane from a point of contact of the pick roller 104 to the media), as referred to further herein as a pick roller up state. The end of the pick arm 106 coupled to the pick roller 104 follows the height of the pick roller 104 and translates the position to place a pivot 108 in an forward orientation associated with the pick roller up state.

The separation wall 120 of FIGS. 5-7 is oriented at an angle with respect to a surface of an input tray where media is placeable in the media tray assembly 102. The pick arm 106 may be rotationally coupled to the pivot 108 and the pivot 108 may be adjustable to maintain the pick roller 104 at a distance (i.e., distance D in FIGS. 5-7) from the angled separation wall 120. The position of the pivot 108 is guided by the pivot link 124 (that is rotationally connected to the media tray assembly 102 at pin 150), the pin and slot interface 110 between the pick arm lift shaft 118 (not shown in FIGS. 5-7) and the pick arm lift plate 116, and the pin and slot interface 148 between the pick arm lift plate 116 and the pivot link 124. The pin and slot interface 148 includes a pin 142 coupled to the plate 116 that orthogonally follows a slot 144 of the pivot link 124. The pick arm 106, the link 124, the pick arm lift shaft 118, and the pick arm lift plate 116 adjust to be in orientations associated with the pick roller up state. For example, the pick arm 106 may be in a fully extended along a horizontal state, the pivot link 124 may lean slightly towards the separation wall 120, the pick arm lift shaft 118 may be rotated in an upward position, and the pick arm lift plate 116 may be rotated in an upward position.

The orientation of the pick arm lift plate 116 may determine the orientation of the separation roller linkage 126, which, in turn, may determine the feed angle of separation rollers 128. For example, separation rollers 128 may be placed to orient the media feed angle θ based on the position of the separation roller link 126 when the pick arm lift plate 116 is in an orientation associated with the pick roller up state. One of the separation rollers 128 may be adjustable while the other is fixed so that an axis of a center of a first separation roller 128 is to rotate about an axis through a center of a second separation roller 128 (e.g., at pin 152). As shown with reference to FIGS. 5-7, the separation rollers have a variable feed angle with respect to the positions of each other and the variable feed angle is dependent on the position of the pivot 108 as translated through the pin and slot interfaces to adjust the position of the separation rollers 128 (e.g., via the separation roller linkage 126). In this manner, the variable feed angle may be adjusted with respect to the position of the pick roller 104 (e.g., the variable feed angle is dependent on stack height).

Referring to FIG. 6, the media feed system 100 is depicted at a pick roller mid state (e.g., a partial media stack height state). The pick roller 104 is in a position with vertical alignment at about the middle of the separation wall 120 and maintained at the distance D from the separation wall 120 (e.g., distance D along a horizontal plane). The other components of the media feed system 100 adjust in conjunction with the change in the height of the pick roller 106. For example, the pick arm 106 may have a slight slope of approximately 10-15 degrees from a horizontal plane, the pivot link 124 may adjust from a lean to about a vertical alignment (e.g., the length of the pivot link 124 oriented substantially along a vertical plane), the pick arm lift shaft 118 may be in a middle and upright orientation, and the pick arm lift plate 116 may be rotated with a slight slope of approximately 10-15 degrees from a horizontal plane. In that example, the components may be part of or otherwise connected to a four-bar linkage that facilitates the orientations of the components to be associated with the pick roller mid state, such as via movements depicted with regards to FIGS. 3B and 3C. A media stack 180 is shown in FIG. 6 for reference, but is not shown in FIGS. 5 and 7 to retain clarity. The media stack 180 is abutted against the separation wall 120 at about the angle of the separation wall 120.

As orientation of the pick arm lift plate 116 adjusts to the pick roller mid state, the orientation of the separation roller linkage 126 and the feed angle of the separation rollers 128 may adjust accordingly. For example, separation rollers 128 may be placed to orient the media feed angle α based on the position of the separation roller link 126 when the pick arm lift plate 116 is in an orientation associated with the pick roller mid state where the media feed angle α is a smaller angle (e.g. shown with a larger slope with respect to a horizontal plane) than the media feed angle θ of FIG. 5.

Referring to FIG. 7, the media feed system 100 is depicted at a pick roller down state (e.g., an empty media stack height state). The pick roller 104 is in a position with vertical alignment at about the bottom of the separation wall 120 and maintained at the distance D from the separation wall 120. The other components of the media feed system 100 adjust in conjunction with the change in the height of the pick roller 104. For example, the pick arm 106 may have a slight slope of approximately 20-30 degrees from a horizontal plane, the pivot link 124 may lean slightly away from the separation wall 120, the pick arm lift shaft 118 is in a down and back orientation, and the pick arm lift plate 116 may be rotated with a slope of approximately 20-30 degrees from a horizontal plane. In that example, the orientations of the components may be associated with a pick roller down state.

As orientation of the pick arm lift plate 116 adjusts to the pick arm down state, the orientation of the separation roller linkage 126 and the feed angle of the separation rollers 128 may adjust accordingly. For example, separation rollers 128 may be placed to orient the media feed angle β based on the position of the separation roller link 126 when the pick arm lift plate 116 is in an orientation associated with the pick roller down state where the media feed angle β is a smaller angle (e.g. shown with a larger slope with respect to a horizontal plane) than media feed angle α of FIG. 6.

The states shown in FIGS. 5-7, as well as other states described herein, include example orientations of the components of the media feed system 100. For example, additional states may be used within the ranges described. For another example, the states may be representational of a substantially continuous set of states of components ranging from the pick roller 104 positioned for a maximum media stack height (e.g., a full tray) to the pick roller 104 position for a minimum media stack height (e.g., an empty tray).

FIGS. 8A-C depict example states of the pin and slot interface 110 of the media feed system 100 at various states of operation. Referring to FIG. 8A, the pin 112 orthogonally located at a first end of the slot 114 associated with a pick roller up state. Referring to FIG. 8B, the pin 112 is orthogonally located between the ends of the slot 114 associated with a pick roller mid state. Referring to FIG. 8C, the pin 112 orthogonally located at a second end of the slot 114 associated with a pick roller down state.

Figure 9A:
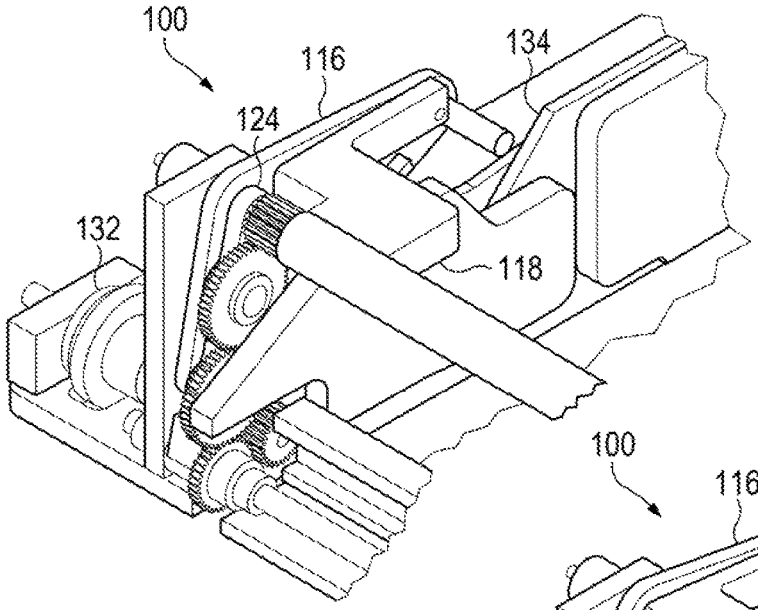
Figure 9B:
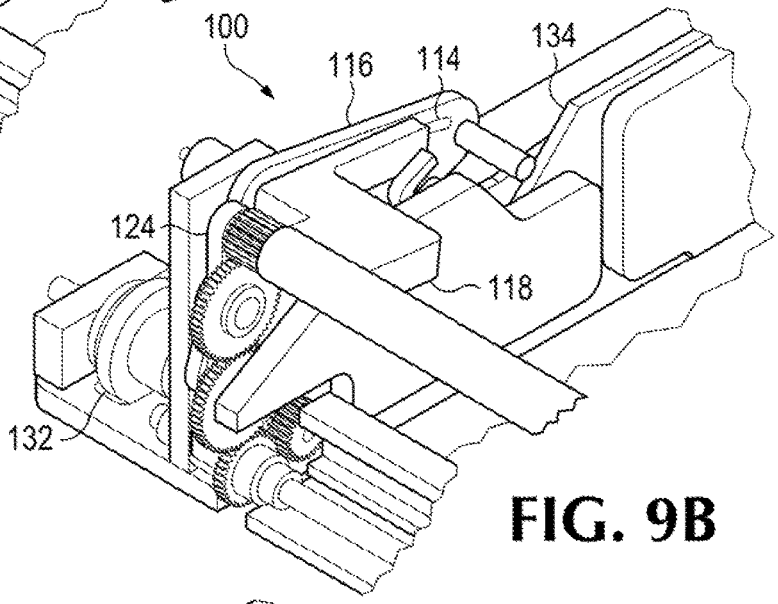
Figure 9C:
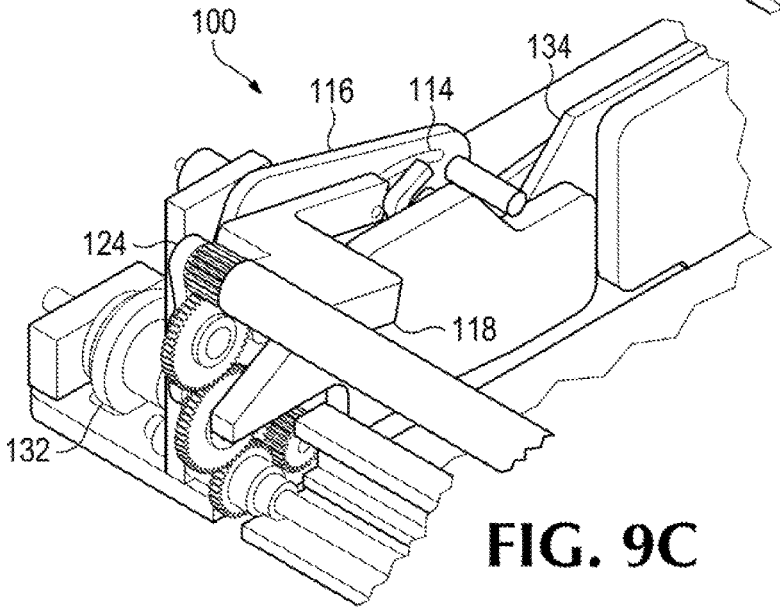

FIGS. 9A-C depict example states of the lift shaft 118 of the media feed system 100 at various states of operation. The location of the pin 112 (not shown in FIGS. 9A-C) within the slot 114 (not shown in FIG. 9A) directs the orientation of the lift shaft 118. Referring to FIG. 9A, the pick arm lift shaft 108 is in an up and forward orientation associated with a pick roller up state. Referring to FIG. 9B, the pick arm lift shaft 118 is in a middle and upright orientation associated with a pick roller mid state. Referring to FIG. 9C, the pick arm lift shaft 108 is in a down and back orientation associated with a pick roller down state.

Figure 10A:
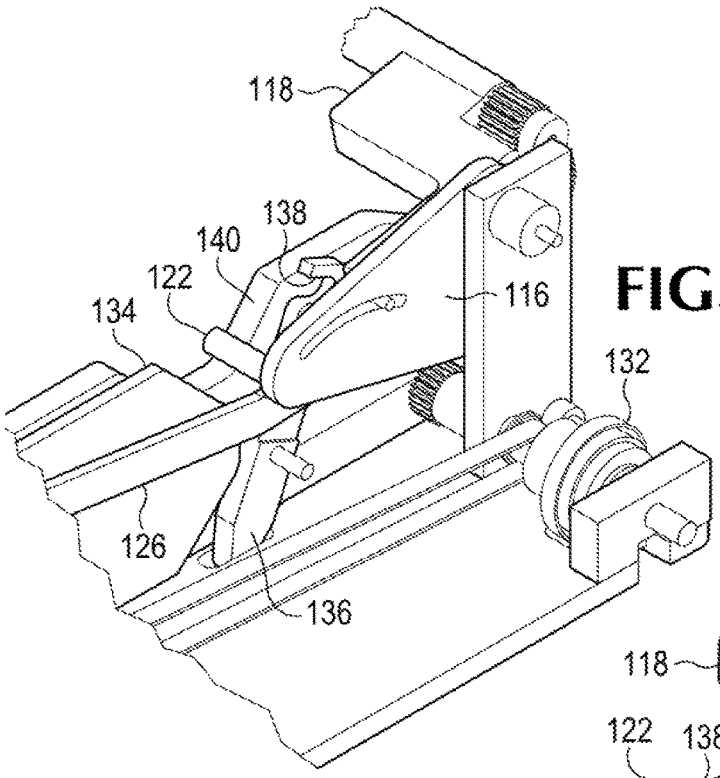
Figure 10B:
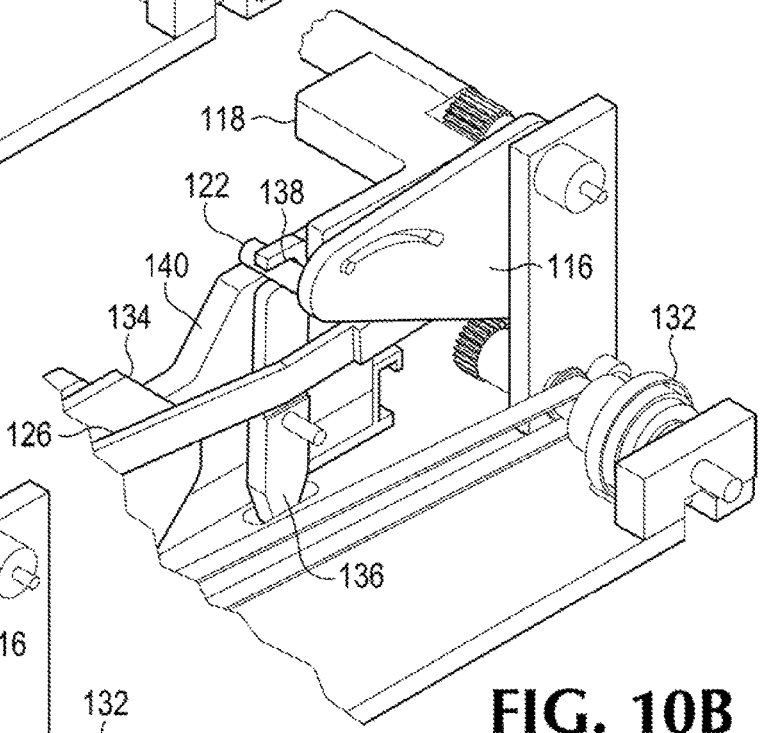
Figure 10C:
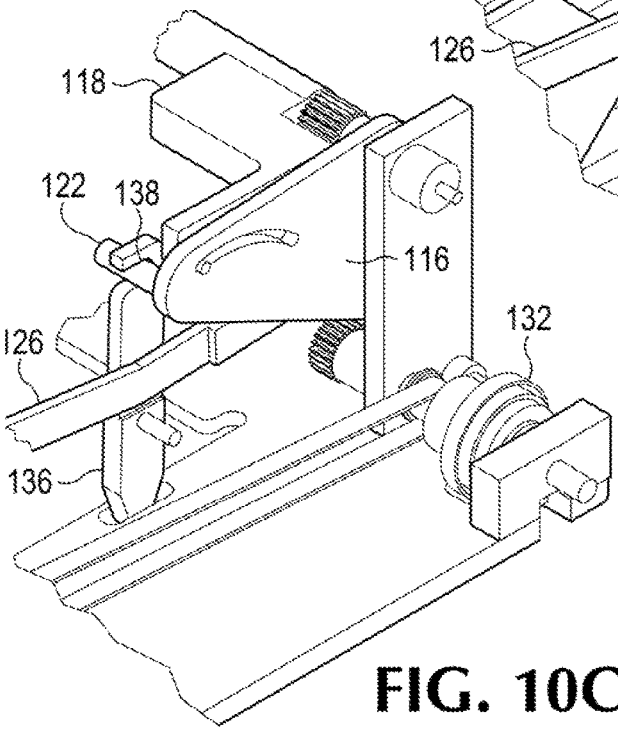

FIGS. 10A-C depict example states of the pick arm lift lock 136 of the media feed system 100 at various states of operation. Referring to FIG. 10A, the tray assembly 102 includes a tray wall 134 with a surface 140 of the tray wall having a slope. The sloped surface 140 of the tray wall 134 is able to catch a protrusion 122 extending from a surface of the pick arm lift plate 116. In FIG. 10A, the tray assembly 102 is in an inserted state (e.g., unlocked state) and the protrusion 122 is in contact with the tray wall at the base of the slope of the tray wall 134. The pick arm lift lock 136 may be an arm member that is in a slanted orientation when the tray assembly 102 is in an inserted or unlocked state.

The pick arm lift lock 136 has a surface defining an aperture 138 and the sloped surface 140 may lead to the aperture 138. Referring to FIG. 10B, the pick arm lift lock 136 is operably coupleable with a protrusion 122 extending from the pick arm lift plate 116. The pick arm lift lock 136 is oriented into an upright orientation upon removal of the tray from the tray assembly 102 and the protrusion 122 of the pick arm lift plate 116 slides up the sloped surface 140 to couple with the upright pick arm lift lock 136 at the aperture 138. In this manner, the pick arm 106 (not shown) is liftable to a lifted position via the sloped surface 140 and the protrusion 122 is insertable into the aperture 138 of the pick arm lift lock 136. Referring to FIG. 10C, the pick arm lift lock 136 is able to sustain the pick arm 106 in the lifted state (e.g., a state where the pick arm is lifted to a substantially horizontal orientation) when engaged by the protrusion 122 of the pick arm lift plate 116 as the tray is removed. In this manner, the tray assembly 102 is able to be loaded with media and inserted back into an imaging device with the hanging pick arm 106 moved out of the path of tray during reinsertion.

Figure 11:
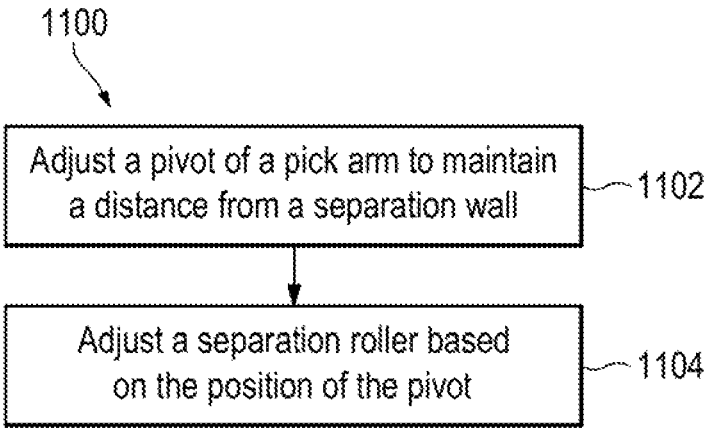
FIGS. 11-13 are flow diagrams depicting example methods of operating a media feed system.
Figure 12:
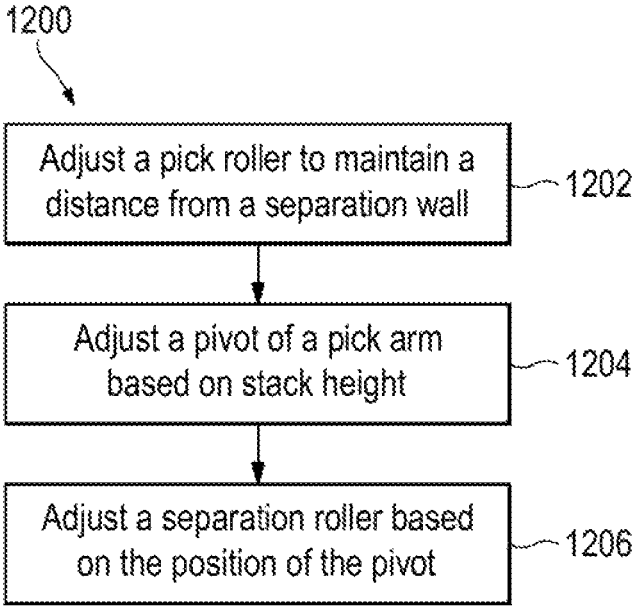
Figure 13:
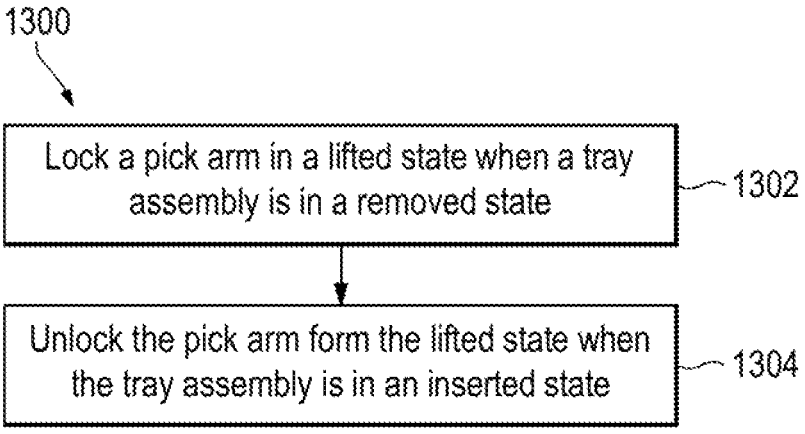

FIGS. 11-13 are flow diagrams depicting example methods 1100, 1200, and 1300 of operating a media feed system. Referring to FIG. 11, the example method 1100 of operating a media feed system, such as media feed system 100 discussed herein, may generally comprise adjusting a pick roller to maintain a distance from a separation wall and adjusting a separation roller based on the position of the pick roller.

At block 1102, a position of a pivot of a pick arm is adjusted to maintain a pick roller at a substantially constant distance from an angled separation wall. The separation wall may be angled with respect to a vertical plane. The angled separation wall may place the point of pick roller at various areas of the plane of the media in the event of a pick roller with a fixed pick arm pivot position, however, a pick roller with a variable pick arm pivot position may substantially maintain the position of the pick roller at substantially the same location on each sheet of media of a stack of media when the media is stacked against an angled separation wall (e.g., with the sheet entering sides lined of a stack of media staggeredly aligned on the surface of the angled separation wall).

At block 1104, a position of a separation roller is adjusted based on the position of the pivot of the pick arm. The position of the separation roller may be adjusted to adjust the media feed angle so that a sheet of media on the top of the media stack is received by a media feed angle that is shallower than a media feed angle of a sheet of media at the bottom of the media stack, for example. The position of the pick roller with respect to the separation wall and the media feed angle are, in this manner, adjustable in conjunction with the other to coordinate proper feeding of media from a media stack in a media tray with an angled separation wall.

FIG. 12 includes blocks similar to blocks of FIG. 11 and provides additional blocks and details. In particular, FIG. 12 depicts additional blocks and details generally regarding adjusting a pick roller and adjusting a pivot based on stack height.

At block 1202, a position of a pick roller is adjusted to maintain a substantially constant distance from an angled separation wall. At block 1204, a position of a pivot of a pick arm is adjusted based on stack height (e.g., based on the position of the pick roller). The position of the pivot of the pick arm may adjust in conjunction with adjustment of the pick roller (such as adjustments as described herein with respect to FIGS. 1-10) which position is adjusted based on the height of the stack of media on which the pick roller may rest. For example, a pivot may be coupled at a first end of a pick arm and a pick roller coupled to a second end of the pick arm opposite the first end so that when the pivot moves when the pick roller moves based on changes in orientation of the pick arm. The position of the pivot and the orientation of the pick arm may be definable within a path, such as by using a path defined by a pin and slot interface such as the path defined by the pin and slot interfaces 110 and 148 of FIGS. 3B and 3C. At block 1206, a position of a separation roller is adjusted based on the position of the pivot of the pick arm.

The operations of blocks 1102 and 1104 of FIG. 11 and blocks 1202, 1204, and 1206 of FIG. 12 may be performed concurrently based on the coupling among component of the media feed system. The concurrent adjustment of the position of the pick roller, the position of the pivot of the pick arm, and the position of the separation roller may happen in at least partial concurrence, such as all adjustments occurring simultaneously at the corresponding time or a chain reaction of movements along the linked component pairs (e.g., based on the interfaces of the components).

Referring to FIG. 13, the example method 1300 of operating a media feed system, such as media feed system 100 of FIGS. 10A-C, may generally comprise locking and unlocking a pick arm. At block 1302, the pick arm is locked in a lifted state when a tray assembly is in a removed state. At block 1304, the pick arm is unlocked from the lifted state when the tray assembly is in an inserted state. These operations may be performable by a media feed system with components such as a pick arm lift lock 136 and/or a motor 130 of the media feed system 100 of FIG. 4.

The methods 1100 or 1200 may be combined with the method 1300 to coordinate operation of a media feed system based on the insertion state (e.g., tray inserted, tray partially removed, or tray fully removed) and the height of the media in the media tray assembly.

Although the flow diagrams of FIGS. 11-13 illustrate specific orders of execution, the order of execution may differ from that which is illustrated. For example, the order of execution of the blocks may be scrambled relative to the order shown. Also, the blocks shown in succession may be executed concurrently or with partial concurrence. All such variations are within the scope of the present description.

All of the features disclosed in this specification (including any accompanying claims, abstract and drawings), and/or all of the elements of any method or process so disclosed, may be combined in any combination, except combinations where at least some of such features and/or elements are mutually exclusive.

The present description has been shown and described with reference to the foregoing examples. It is understood, however, that other forms, details, and examples may be made without departing from the spirit and scope of the following claims. The use of the words "first," "second," or related terms in the claims are not used to limit the claim elements to an order or location, but are merely used to distinguish separate claim elements.

What is claimed is:

1. A tray assembly comprising:

a separation wall;

a rigid pick arm having a pivot end with a pivot position and having a free end to position over a media;

a pick roller coupled to the free end of the pick arm;

a second arm having a first end pivotally coupled at the pivot position to the pivot end of the pick arm, and having a second end coupled to a pin; and a first separation roller having a position and a variable feed angle determined with respect to a position of a second separation roller, wherein the pick arm is adjustable at the pivot position, and operable to maintain a distance between the pick roller and the separation wall as the pick arm changes orientation, and wherein the variable feed angle is dependent on stack height of the media.

2. The assembly of claim 1, further comprising:

a plate coupled to the pick arm via a pin and adjustable along the pick arm via a slot interface to adjust a position of the free end over the media and to adjust an orientation of the pick arm.

3. The assembly of claim 1, wherein the second arm is coupled to the plate via a pin and slot interface.

4. The assembly of claim 1, wherein:

the pick arm is to be locked in a lifted state when the tray assembly is in a removed state; and the pick arm is to be unlocked from the lifted state when the tray assembly is in an inserted state.

5. A method of operating a media feed system comprising:

providing the media feed system including;

a rigid pick arm having a pivot end with a pivot position and having a free end to position over a media;

a pick roller coupled to the free end of the pick arm;

a second arm having a first end pivotally coupled at the pivot position to the pivot end of the pick arm, and having a second end coupled to a pin; and a motor coupled to transmission systems to allow the motor to drive the pick roller and a separation roller;

adjusting a first position of the pivot position of the pick arm to maintain the pick roller at a substantially constant distance from an angled separation wall; and adjusting a second position of a separation roller based on the first position of the pick roller, wherein the adjusting the second position of the separation roller establishes a variable feed angle of the separation roller relative to an opposing separation roller, and the variable feed angle is based on a stack height of the media.

6. The method of claim 5, wherein:

the adjusting the first position of the pivot position of the pick arm is based on the stack height of the media and the adjusting the first position of the pivot position of the pick arm and the adjusting the second position of the separation roller occurs concurrently.

7. The method of claim 5, further comprising:

locking the pick arm in a lifted state when a tray assembly is in a removed state; and unlocking the pick arm from the lifted state when the tray assembly is in an inserted state.

8. The method of claim 5, wherein the media feed system includes a plate coupled to the pick arm via a pin and adjustable along the pick arm via a slot interface to adjust a position of the free end over the media and to adjust an orientation of the pick arm.

9. The method of claim 5, wherein the second arm is coupled to the plate via a pin and slot interface.

* * * * *